US005797485A

United States Patent [19]

Gale

[11] Patent Number: 5,797,485

[45] Date of Patent: Aug. 25, 1998

[54] CARRIER FOR BEVERAGE CONTAINERS AND FLAT FOR USE IN MAKING SAME

[76] Inventor: Gregory W. Gale, 3380 Atlas Peak Rd., Napa, Calif. 94558

[21] Appl. No.: 866,336

[22] Filed: May 30, 1997

[51] Int. Cl.[6] ..... B65D 75/00

[52] U.S. Cl. ..... 206/183; 206/162; 206/188

[58] Field of Search ..... 206/162, 170, 206/174, 180, 187, 188, 183, 427

[56] References Cited

U.S. PATENT DOCUMENTS

| | | | |
|---|---|---|---|
| 2,702,144 | 2/1955 | Forrer | 206/188 |
| 3,352,452 | 11/1967 | Graser | 206/187 |
| 3,495,734 | 2/1970 | Hanna et al. | 206/183 |
| 4,201,322 | 5/1980 | Crawford | 206/183 |
| 5,595,291 | 1/1997 | Negelen | 206/162 |

*Primary Examiner*—David T. Fidei
*Attorney, Agent, or Firm*—Flehr Hohbach Test Albritton & Herbert

[57] ABSTRACT

A carrier for beverage containers in which the beverage containers are of a type which have a bottom wall, an upstanding side wall and an openable top. The carrier is formed of a one-piece member formed of a non-plastic material formed into first and second halves adjoining each other at a first fold line. Each half is comprised of counting from the first fold line a handle segment forming the first fold line, a first side wall segment adjoining the handle segment at a second fold line and having first and second side margins, a bottom wall segment adjoining the first side wall segment along a third fold line, a second side wall segment adjoining the bottom wall segment along a fourth fold line and having first and second side edges, first and second end wall segments adjoining respectively the first and second side edges of the second side wall segment. An interlocking tab assembly is carried by the first and second end margins and the first and second side margins for fastening together the first and second end wall segments of one half to the corresponding first and second end wall segments of the other half after the first and second end wall segments have been folded along the fold lines with the wall segments aligned in planes parallel to each other. The handle segments have holes therein adapted to receive the fingers of the hand.

22 Claims, 3 Drawing Sheets

CARRIER FOR BEVERAGE CONTAINERS AND FLAT FOR USE IN MAKING SAME

FIELD OF THE INVENTION

This invention relates to a carrier for beverage containers and a flat for use in making the same.

BACKGROUND OF THE INVENTION

Carriers for beverage containers have heretofore been provided and typically have been formed of standard paperboard to provide basket-type carriers for use as beverage containers for beverages such as beer, sparkling water soft drinks, etc. They however have not been designed so that they can utilize non-plastic material such as molded fibers that can be obtained from recycled materials. There is therefore a need for a carrier for beverage containers which will overcome this deficiency.

SUMMARY OF THE INVENTION

In general, it is an object of the present invention to provide a carrier for beverage containers and flats for use in the beverage containers which make use of molded non-plastic fibers.

Another object of the invention is to provide a carrier of the above character in which cells or cavities are provided to receive the containers to prevent contact of the containers with each other to prevent abrasion of the labels or the containers and particularly glass and also to prevent breakage of glass containers.

Another object of the invention is to provide a carrier of the above character which is provided with multiple cavities or cells for multiple containers and which has the same basic attributes as for example dimensions and configurations as standard paperboard carriers making them useful in existing production and distribution systems.

Another object of the invention is to provide a carrier of the above character which is formed from a one-piece molded fiber flat or platform which can be folded to form the carrier.

Another object of the invention is to provide a carrier of the above character which has a rigid three-dimensional framework.

Another object of the invention is to provide a carrier of the above character which can be folded and fastened together without the use of adhesives.

Another object of the invention is to provide a carrier of the above character in which interlocking tabs are utilized for securing the final assembly.

Another object of the invention is to provide a carrier of the above character in which the cavities are molded to a shape which corresponds to the shape of the container.

Another object of the invention is to provide a carrier of the above character which can incorporate wrap-around labels.

Another object of the invention is to provide a carrier of the above character which is light weight and durable.

Another object of the invention is to provide a carrier of the above character which can be manufactured, assembled and labeled automatically and can be utilized in automation with existing packaging machinery.

Another object of the invention is to provide a carrier of the above character which provides improved insulating properties.

Another object of the invention is to provide a carrier of the above character which does not lose its shape when the beverage containers are removed therefrom.

Another object of the invention is to provide a carrier of the above character which has good wet strength characteristics.

Additional objects and features of the invention will appear from the following description in which the preferred embodiment is set forth in detail in conjunction with the accompanying drawings.

DETAILED DESCRIPTION

In general, the carrier for beverage containers is for use with beverage containers which have a bottom wall, upstanding side wall and a top. The carrier is comprised of a folded flat formed from a one-piece member of a n material. The member is formed into first and second halves adjoining each other at a first fold line. Each half is comprised of, counting from the first fold line, a handle segment, a first side wall segment adjoining the handle segment at a second fold line and having first and second side margins. A bottom wall segment adjoins the first side wall segment along a third fold line and a second side wall segment adjoins the bottom wall segment along a fourth fold line and has first and second side edges. First and second end wall segments adjoin respectively the first and second side wall edges along fifth and sixth fold lines. The first and second end wall segments have first and second end margins. Cooperative mating means is carried by the first and second end margins and the first and second side margins for fastening together the first and second end wall segments of each half to the corresponding first and second segments of the other half. The handle segments of each of the first and second halves lying in parallel planes and have hand holes extending therethrough through which a human hand can be inserted for carrying of the carrier.

Figure 1:
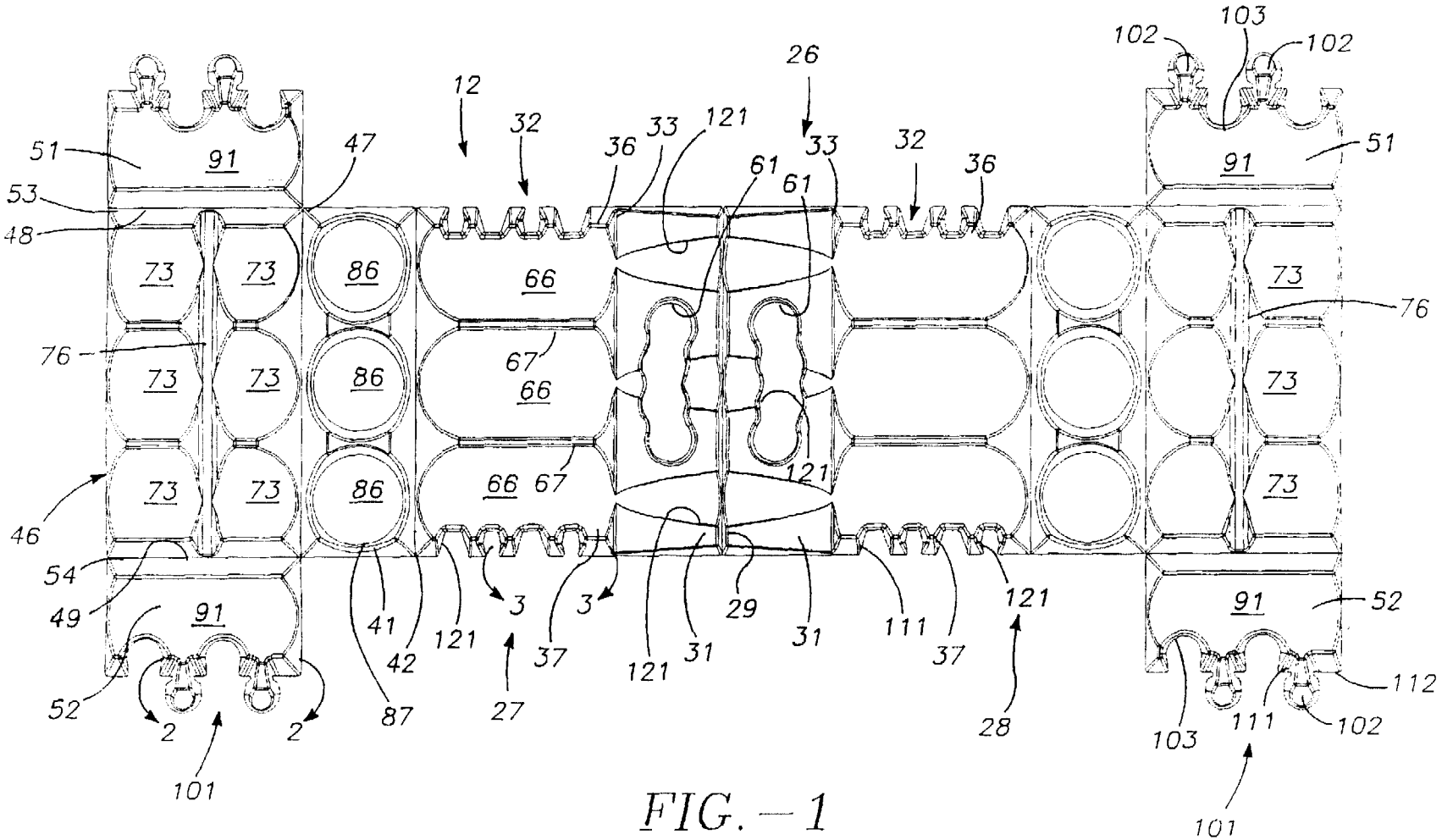
FIG. 1 is a plan view of a flat used for making the carrier of the present invention for beverage containers.
Figure 4:
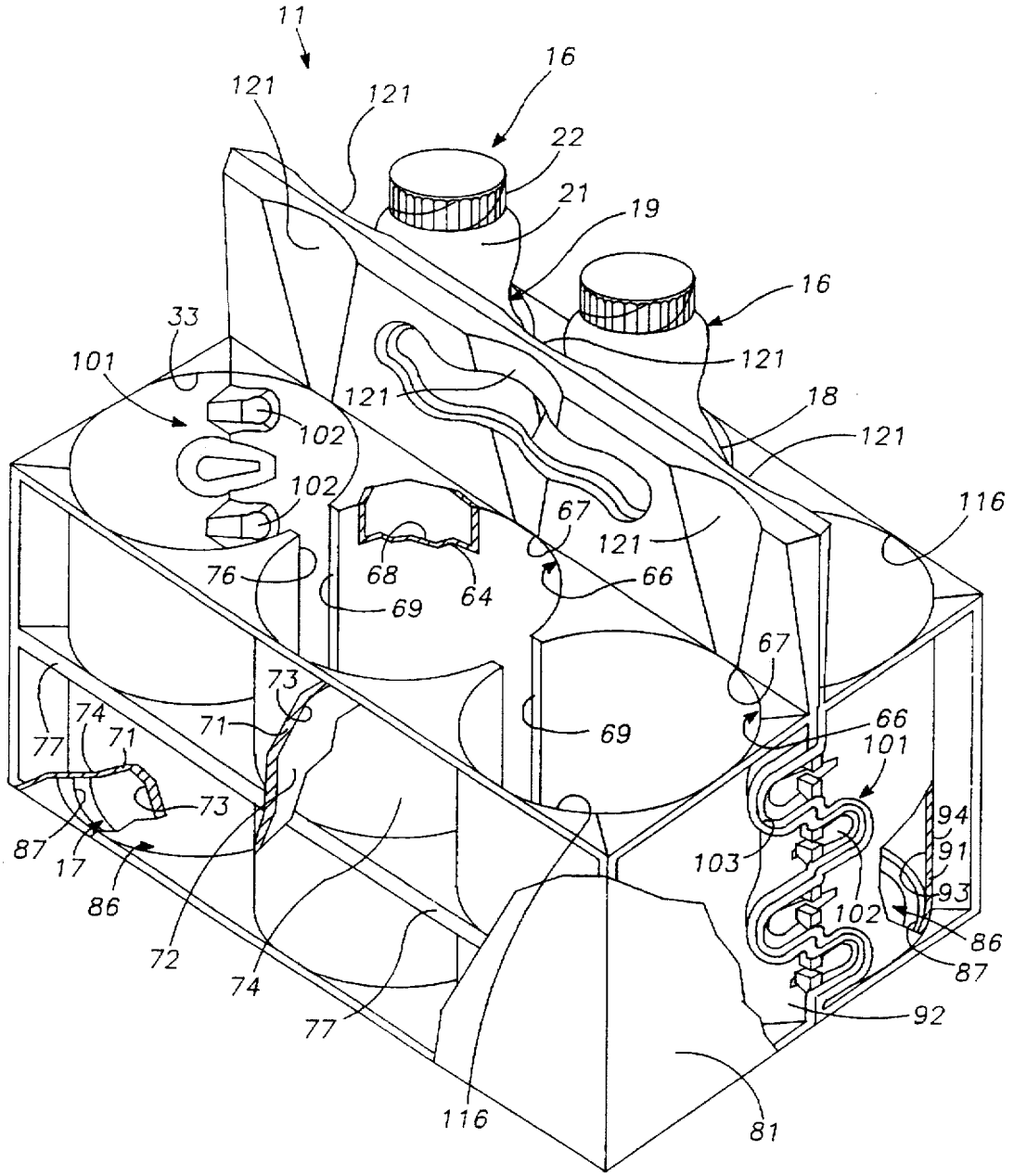
FIG. 4 is an isometric view of the carrier for beverage containers made from the flat shown in FIG. 1 with beverage containers therein and with a wrap-around label.

More in particular, the carrier 11 for beverage containers shown in FIG. 4 and the flat 12 from which the carrier 11 is made is shown in FIG. 1. The carrier is for carrying beverage containers 16 of the type having a bottom wall 17 and an upstanding side wall 18 which is generally cylindrical in shape and a top 19. As shown, the beverage containers 16 can be formed of a suitable material such as plastic and metal or glass. When in the form of a bottle as shown in FIG. 4, the top 19 includes a neck 21 which carries a removable cap 22.

The flat 12 as shown in FIG. 1 is formed from a one-piece member 26 formed of a non-plastic material such as molded fibers. The material forming the member 26 can have a suitable thickness ranging from 0.060" to 0.350". The molded fibers are obtained from utilizing molded pulp which is typically made out of a mixture of newspaper to which has been added hot water with a touch of alum to balance the pH in the water. Other fibrous materials such as leather, plants and the like can be utilized. If a brown or off-white color is desired for the molded pulp, this can be accomplished by adding recycled corrugated board from containers. Any other desired coloring can be achieved by the use of added dyes. The molds for making the member 26 have been formed to provide the flat 12 which is shown in FIG. 1.

The member or flat 26 is formed of two halves 27 and 28 with the two halves adjoining each other along a first fold line 29. Each of the halves 27 and 28 is comprised of, counting from the first fold line 29, a rectangular handle segment 31 so that the handle segment 31 of each of the halves 27 and 28 adjoin along the first fold line 29. A first side wall segment or panel 32 adjoins the handle segment 31 along a second fold line 33. The first side wall segment 32 is provided with first and second side edges 36 and 37.

A bottom wall segment or panel 41 which is rectangular in shape adjoins the first side wall segment or panel 32 along a third fold line 42. A second side wall segment or panel 46 which is rectangular in shape adjoins the bottom wall segment 41 along a fourth fold line 47. The second side wall segment 46 is provided with first and second end edges 48 and 49. First and second end wall segments or panels 51 and 52 adjoin the edges 48 and 49 along fifth and sixth fold lines 53 and 54 which are in registration with the edges 48 and 49. The first and second end wall segments 51 and 52 are provided with end margins 56 and 57 respectively.

Cooperative mating means is carried by the first and second end margins and the first and second side margins for fastening together the first and second end wall segments of one half to the corresponding first and second segments of the other half and serving to interlock the first and second halves and to bring the handle segments together so that they lie in parallel planes. The handle segments include hand openings 61 therein through which a human hand can be inserted for carrying the carrier. As can be seen from FIGS. 1 and 4, the openings 61 extend lengthwise or longitudinally of the handle segments 31 and are sized so that they are adapted to receive the four fingers of a human hand. The openings 61 are in registration with each other to provide additional strength and are spaced intermediate the top and bottom portions of the handle segments of the carrier after it has been erected from the flat.

As can be seen in FIGS. 1 and 4, the carrier is adapted to receive a plurality of the beverage containers as for example six as shown. However it should be appreciated that if desired as few as four and more than six container spaces can be provided in the carrier. Thus the first side wall segments 32 are provided with a wall 64 that forms a plurality of longitudinally extending parallel spaced-apart recesses 66 that are concave in cross-section to provide concave inner and convex outer surfaces 67 and 68. The recesses 66 receive the cylindrical side walls 18 of the beverage containers 16. Thus as shown the first side wall segments have been provided with three of such upstanding parallel recesses 66 between which there are provided two upstanding spaced apart parallel ridges 69 disposed between the center innermost recess 66 and the outer recesses 66 on each side.

The second side wall segment 46 is also provided with a plurality of longitudinally extending spaced-apart walls 71 forming parallel spaced-apart recesses 72 that are concave in cross-section and face the opposite concave recesses 66. The recesses 72 provided concave inner and convex outer surfaces 73 and 74. The concave surfaces 73 are adapted to receive the other sides of the cylindrical side walls 18 of the containers 16 so as to form a relatively snug fit with the side walls of the containers 16. Upstanding longitudinally extending parallel ridges 76 corresponding to the ridges 69 are disposed between the conical recesses 72 in the same manner as the ridges 69. As shown when the carrier is assembled as shown in FIG. 4, the ridges 69 and 76 are still spaced apart from each other so that the containers can be snugly fitted within the carrier 11.

The member 26 is provided with a transversely extending reinforcing rib 77 also formed of the same material as the member 26 and integral with the member 26. The rib 77 extends along the length of the second side wall segment 46 from the first and second end wall segments 51 and 52. This reinforcing rib 77 provides additional structural support for the carrier 11 and also provides an additional surface for adherence of a wrap-around label 81 which can extend around all four sides of the carrier. The label 81 can be provided with appropriate label information as for example a trademark and the like.

The bottom wall segment 41 is provided with a plurality as for example three as shown of cup-shaped recesses 86 which are in alignment with the concave recesses 66 and 72 in the first and second side wall segments 32 and 46. The cup-shaped recesses 86 are formed by circular inwardly and downwardly inclined side walls 87 and are adapted to receive the bottoms of the containers to keep the containers separated and from touching each other in cooperation with the upstanding ridges 69 and 76. As shown, the cup-shaped recesses or wells 86 are circular in shape and the inclined side walls 87 facilitate nesting of the containers.

The first and second end wall segments 51 and 52 are also provided with a wall 91 that forms longitudinally extending recesses 92 that are concave in cross-section to provide concave inner and convex outer surfaces 93 and 94. The concave recess 92 receives the side of the container at right angles to the sides engaged by the concave recesses 66 and 71.

The cooperative mating means for interlocking the first and second halves 27 and 28 hereinbefore described consists of an interlocking tab assembly 101. The interlocking tab assembly 101 consists of cup-shaped or horseshoe-shaped tabs 102 which are adapted to interfit cup-shaped or horseshoe-spaced recesses 103. As can be seen, each of the first and second end wall segments 51 and 52 are each provided with two cup-shaped tabs 102 and two cup-shaped recesses 103 to provide a combination of four. The cup-shaped tabs and the cup-shaped recesses 102 and 103 for the first and second end wall segments of each half are offset or staggered with respect to each other and similarly, the cup-shaped tabs 102 and the cup-shaped recesses 103 of the first and second end wall segments are offset or staggered from the cup-shaped tabs and cup-shaped recesses 102 and 103 of the first and second end wall segments of the second half. Described in another way, the cup-shaped tabs 102 and the cup-shaped recesses 103 are arranged for the end wall segment 51 that when viewed from the left as shown in FIG. 1, a cup-shaped tab 102 appears on the left followed by a cup-shaped recess 103 and then followed by a cup-shaped tab 102 and another cup-shaped recess 103 whereas for end wall segment 52 from the left, a cup-shaped recess 103 first occurs followed by a cup-shaped tab, then another cup-shaped recess and another cup-shaped tab. Similarly, the end wall segment 5I has looking from left to right in FIG. 1 a cup-shaped tab 102 followed by a cup-shaped recess 103 followed by a cup-shaped tab 102 and a cup-shaped recess 103 and similarly the end wall segment 52 looking from left to right in FIG. 1 there first appears a cup-shaped recess 103 followed by a cup-shaped tab 102, a cup-shaped recess 103 and a cup-shaped tab 102.

Figure 2:
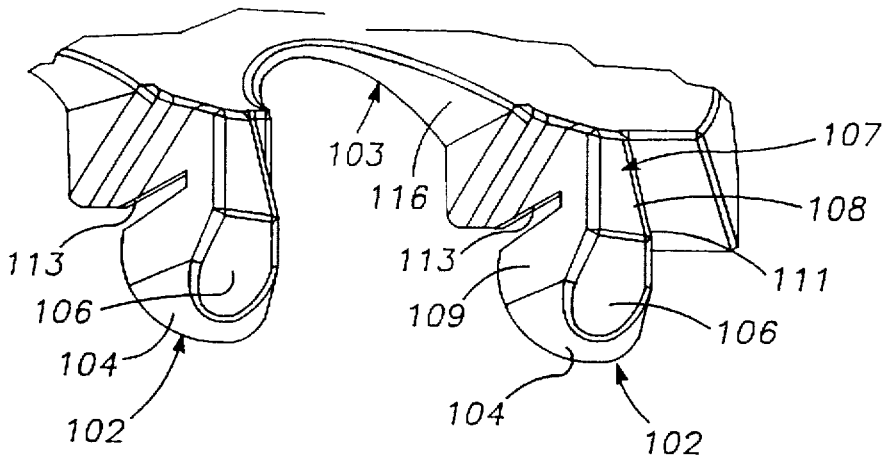
FIG. 2 is an enlarged isometric view of the portion encircled by the lines 2—2 of FIG. 1 and particularly showing the male half of the interlocking tab assembly utilized in the carrier.
Figure 3:
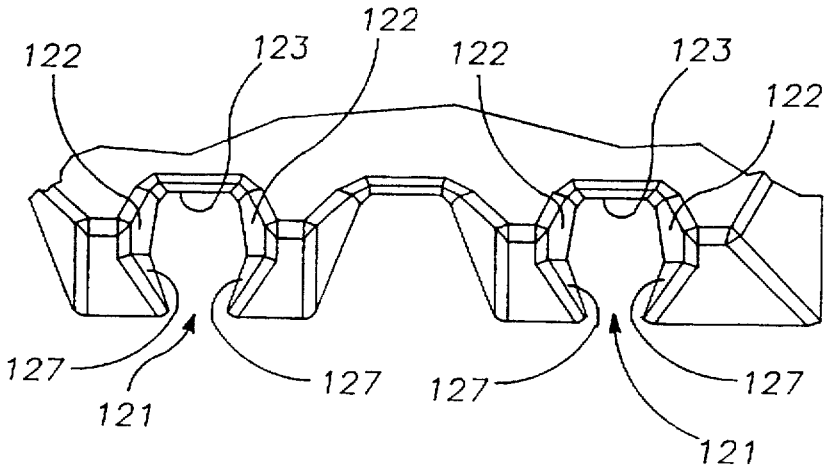
FIG. 3 is an enlarged isometric view of the portion of the flat encircled by the line 3—3 of FIG. 1 and particularly showing the female recesses of the female half of the same interlocking tab assembly.

As shown in FIG. 2, the cup-shaped or horseshoe-shaped tabs 102 are each provided with a tapered or inwardly and downwardly extending conical surface 104 which forms a part of a truncated cone. Each tab 102 is also, provided with a generally planar inclined camming surface forming a flat 106. Each tab 102 is supported in a cantilever fashion by an arm 107 formed integral therewith and which is also formed integral with the wall 91 of the end wall segment. The arm 107 is provided with an outer planar surface 108 which is tapered proximally and is provided with downwardly and outwardly extending inclined side walls 109 and 111. The side walls 109 and 111 are provided with tapered recesses or notches 113 to facilitate bowing inwardly of the side walls 109 and 111 for a purpose hereinafter described. The cup-shaped recesses 103 between the cup-shaped tabs 102 are formed by arcuate inclined surfaces 116 which are adapted to be engaged by the curved surfaces 104 carried by the cupshaped tabs 102.

The interlocking tab assemblies 101 also include locking notches 121 provided in the first and second side margins 36 and 37 of the first side wall segments 32. These locking notches 121 are formed by inclined side walls 122 which provide a U-shaped configuration in cross-section to form a generally square recess 123 which opens forwardly through a portal or throat 126 formed by inwardly inclined forwardly extending spaced-apart walls 127. The portal or throat 126 is slightly narrower than the width of the recess 123 for a purpose hereinafter described.

The flats as shown and described in FIG. 1 can be stacked one above the other and loaded onto pallets until they are ready for use after which they can be taken one by one and erected into carriers either by hand or by automatic machinery. Typically this can be accomplished by grasping the flat by inserting fingers into the hand holes 61 and raising the flat and causing it to fold about the fold line 29 to cause the two halves to come together and to bring the handle segments so they lie parallel to each other and so that the first side wall segments of each half lie against each other and are parallel to each other. Thereafter, halves 27 and 28 can be folded by bending the flat along the fold line 42 so that the bottom wall segment lies at an angle which is approximately 90° with respect to the angle of the first side wall segment 32. Thereafter, the second side wall segment can be folded with respect to the fourth fold line 47 to extend at right angles to the bottom wall segment 41 and is generally parallel to the first side wall segment or panel 32. The other half is folded in a similar manner after which the interlocking tab assembly as shown in FIG. 4 can be placed into interlocking engagement by first bending the end wall segments 51 and 52 along the fifth and sixth fold lines 53 and 54 so that they extend at 90° angles with respect to the second side wall segments and are perpendicular to the bottom wall 41 and parallel to the first and second side wall segments. Then the cup-shaped tabs 102 on the end wall segment 52 of one half section are pressed into the mating recesses 103 of the corresponding end wall segment 52 of the other half 28. During the time this is occurring, the side walls 109 and 111 are brought into engagement with the portal or throat 126 of each of the locking notches 121. As inward movement of the cup-shaped tabs 102 is occurring, the side walls 109 and 111 will be pressed or bent inwardly by the narrowing of the portal or throat 126. This inward bending is facilitated by slots 113 provided in the walls 109 and 111. Upon continued inward movement of the cup-shaped tabs 102, the arms 107 move into the U-shaped recesses 123 and the walls 109 and 11 will snap outwardly and lock into place serving to retain the cup-shaped tabs 102 within the cup-shaped recesses 103 to complete the interlocking arrangement. The same can be done with the tabs 102 of the end wall segments 51 of the first and second halves 27 and 28 so that the end walls are fastened together and also are mated with the first side wall segments by engagement in the tapered recesses 111. By use of the interlocking tab assemblies 101 it can be seen that the carrier can be assembled without the use of an adhesive. In this manner there are provided a plurality of cells or cavities 116 which have been molded to fit the shape (typically cylindrical) of the container to be carried by the carrier. These customized cells or cavities 116 provide a very stable fit for the containers. In addition, the use of the molded fibers for the material provides good insulation where that is desired. As pointed out previously, the construction of the carrier is such that the cavities or cells 116 serve to retain the containers out of engagement with each other so that there is no abrasion of the labels or the containers. This isolation is also very desirable to prevent breakage in the event that glass containers are being carried by the carrier.

The handle segments 31 are provided with vertically extending conical shaped concave recesses 121 which are in alignment, with the cavities 116 to facilitate insertion and removal of the containers 16 from the cavities or cells 116.

From the foregoing it can be seen that there has been provided a new and improved carrier for beverage containers which has many advantageous features. It has a rigid three-dimensional framework which has many advantages. It is light weight and durable and provides superior protection for the containers carried thereby. With a printed wrap-around label it provides an aesthetically pleasing package. The construction is such that it can be assembled and labeled in automatic packaging machinery. Use of the molded fibers in the carrier provides superior insulation for beverages which is particularly desirable for refrigerated beverages. The carrier is made of recyclable materials which also can be recycled. This recycling capability can be enhanced by the use of aqueous inks and starch based adhesives for the wrap-around label. The carrier because of its construction has excellent wet strength characteristics.

What is claimed:

1. A carrier for beverage containers in which the beverage containers are of a type which have a bottom wall, an upstanding side wall and an openable top, said carrier being formed of a one piece member formed of a non-plastic material formed into first and second halves adjoining each other at a first fold line, each half being comprised of counting from the first fold line a handle segment forming the first fold line, a first side wall segment adjoining the handle segment at a second fold line and having first and second side margins, a bottom wall segment adjoining the first side wall segment along a third fold line, a second side wall segment adjoining the bottom wall segment along a fourth fold line and having first and second side edges, first and second end wall segments adjoining respectively the first and second side edges of the second side wall segment and cooperative interlocking mating means carried by the first and second end margins and the first and second side margins for fastening together the first and second end wall segments of one half to the corresponding first and second end wall segments of the other half after the first and second end wall segments have been folded along the fold lines with the wall segments aligned in planes parallel to each other, said handle segments having holes therein adapted to receive the fingers of the hand.

2. A carrier as in claim 1 wherein said first and second halves form spaced apart and separated cells for the containers that prevent the containers from coming in contact with each other.

3. A carrier as in claim 1 together with a wrap-around label secured to the container.

4. A carrier as in claim 2 wherein said containers have side walls which are cylindrical and wherein said cells are cylindrical.

5. A carrier as in claim 1 wherein said cooperative interlocking mating means is in the form of interlocking cup-shaped tabs and cup-shaped recesses for receiving the cup-shaped tabs.

6. A carrier as in claim 1 wherein said first and second side wall segments and said first and second end wall segments have a plurality of longitudinally extending curved recesses therein for engagement with the side walls of the container.

7. A carrier as in claim 1 wherein said second side wall segments are provided with horizontally extending reinforcing ribs disposed intermediate between the upper and lower portions of the second side wall segments.

8. A carrier as in claim 1 wherein said bottom wall segment is formed with cup-shaped recesses in registration with the curved recesses for receiving the bottoms of the containers.

9. A carrier as in claim 5 wherein said cup-shaped tabs and cup-shaped recesses are carried by the first and second end wall segments.

10. A carrier as in claim 9 wherein each of said first and second end wall segments carries a plurality of said cup-shaped tabs and cup-shaped recesses.

11. A carrier as in claim 1 further comprising interlocking notches formed in the first and second side margins of the first and second side walls segments, said notches being comprised of generally rectangular recesses having widths and having entrance throats thereto leading to the recesses which have widths which are less than the widths of the recesses and wherein said cup-shaped tabs are provided with arms having deflectable side walls and wherein said deflectable side walls of said cup-shaped tabs are locked into position in said cup-shaped notches when said cup-shaped tabs are received within the cup-shaped recesses.

12. A flat for assembly into a carrier for containers of the type which have a bottom wall and upstanding side wall and an openable top, said flat comprising a one piece member formed of a non-plastic material and lying in a plane, said member being formed into first and second halves adjoining each other at a first fold line, each half being comprised of counting from the first fold line a handle segment adjoining the first fold line, a first side wall segment adjoining the handle segment at a second fold line and having first and second side margins, a bottom wall segment adjoining the first side wall segment along a third fold line, a second side wall segment adjoining the bottom wall segment along a fourth fold line and having first and second edges, first and second end wall segments adjoining respectively the first and second side edges along fifth and sixth fold lines, said first and second end wall segments having first and second end margins and cooperative interlocking mating means carried by the first and second end margins and the first and second side margins for fastening together the first and second end wall segments of one half to the corresponding first and second end segments of the other half.

13. A flat as in claim 12 wherein said handle segments, said first side wall segment, said bottom wall segment, said second side wall segment and said first and second end wall segments have a generally rectangular configuration.

14. A flat as in claim 13 wherein said first, second, third and fourth fold lines are parallel to each other and wherein said fifth and sixth fold lines are perpendicular to said first, second, third and fourth fold lines.

15. A flat as in claim 12 wherein said non-plastic material is a molded fiber material.

16. A flat as in claim 15 wherein said molded fiber material has a thickness ranging from 0.060" to 0.350".

17. A flat as in claim 12 wherein said handle segments have longitudinally extending holes formed and adapted to receive the fingers of the human hand.

18. A flat as in claim 12 wherein said first and second side wall segments and said first and second end wall segments have longitudinally extending curved surfaces therein which are adapted to mate with the side wall of the container.

19. A flat as in claim 12 wherein said cooperative mating means is in the form of cup-shaped tabs and cup-shaped recesses.

20. A flat as in claim 19 wherein the cup-shaped tabs are spaced apart and have cup-shaped recesses disposed between adjacent cup-shaped tabs.

21. A flat as in claim 12 further comprising a reinforcing rib extending substantially the entire length of each of the second side wall segments of each of the first and second halves.

22. A flat as in claim 20 wherein said cup-shaped tabs are supported on arms having spaced-apart deflectable side walls and wherein said first side wall segments are provided with first and second side margins and wherein a plurality of spaced-apart recesses are provided therein with a narrowed throat providing an entrance thereto, said narrowed throat being adapted to cooperatively engage with the side walls of the arms to deflect the side walls of the arm upon entrance into the recess so that when the side walls enter into the recesses they are locked into the recesses.

* * * * *